United States Patent [19]

Glassby

[11] Patent Number: 4,482,144

[45] Date of Patent: Nov. 13, 1984

[54] GRASPING DEVICE FOR STACKED WORKPIECES

[75] Inventor: Kenneth B. Glassby, Rapallo, Italy

[73] Assignee: Rockwell-Rimoldi S.p.A., Italy

[21] Appl. No.: 476,699

[22] Filed: Mar. 18, 1983

[30] Foreign Application Priority Data

Apr. 1, 1982 [GB] United Kingdom ..... 8209702

[51] Int. Cl.[3] ..... B65H 3/30

[52] U.S. Cl. ..... 271/21; 294/110 R; 414/119; 414/123

[58] Field of Search ..... 271/19, 21, 22, 23, 271/24, 25, 42, 128, 130; 294/100, 110 R; 414/119, 117, 120, 123

[56] References Cited

U.S. PATENT DOCUMENTS

| | | | |
|---|---|---|---|
| 2,042,734 | 6/1936 | Roy | 271/21 |
| 3,813,094 | 5/1974 | Walton et al. | 271/19 |
| 4,157,824 | 6/1979 | Littlewood | 414/120 |

FOREIGN PATENT DOCUMENTS

| | | | |
|---|---|---|---|
| 678157 | 8/1952 | United Kingdom | 271/43 R |

*Primary Examiner*—Duane A. Reger
*Assistant Examiner*—John A. Carroll

[57] ABSTRACT

A grasping device for workpieces arranged in a stack which includes a support bracket pivotably attached to a spindle that is mounted for vertical movement in a block that is adapted to engage the upper workpiece in the stack. The end of the support bracket opposite its point of attachment to the spindle has a roller rotatably mounted thereon which has a covering of material possessing a high coefficient of friction. A ratchet device operatively interconnects the roller with the support bracket and serves to permit the roller to rotate only in one direction. When the spindle is lowered, the roller rolls on the upper workpiece away from the block and when the spindle is raised the roller unable to rotate is pulled across the upper workpiece toward the block and forms a bunch or fold in the upper workpiece intermediate the block and roller which facilitates manual removal of the workpiece upon lifting the device clear of the stack.

6 Claims, 3 Drawing Figures

GRASPING DEVICE FOR STACKED WORKPIECES

BACKGROUND OF THE INVENTION

1. Field of the Invention

The present invention pertains to a grasping device for arranging stacked workpieces so as to facilitate their removal from a stack. The device is adapted to be applied to a pickup and transporting machine whereby the machine delivers each piece within reach of an operator who relocates the piece for the purpose of performing additional manufacturing operations thereto as, for example, the assembly of pieces by means of a sewing machine.

2. Description of the Prior Art

As is well known to those conversant in the art, it is rather difficult to pick up a single piece of material manually from a pile or stack prior to the sewing operation which are formed to a particular size by means of cutting shears which cut the entire stack simultaneously that consists of twenty to fifty pieces. In an effort to increase the speed of removing the upper workpiece from a stack, a number of different devices have been made available which include pneumatic, mechanical and electro-mechanical devices. Pneumatic devices are based on the formation of a vacuum on the piece to be picked up, however, they are considered expensive and cannot be used in all types of factories as, for instance, in the smaller factories where compressed air systems are not available. Mechanical devices have also been available such as, for example, the one disclosed in U.S. Pat. No. 2,042,734. The teachings of this patent disclose two rollers which can move across the upper surface of the stack of pieces but are prevented from rotating so that they create a bunch or fold on the top piece which is raised from the piece immediately below and then can be moved away from the device by means of a movement parallel to the axis of the two rollers. The two rollers are adapted to rotate only during their backward movement, i.e. the reverse movement with respect to the one which has caused the separation of the top piece from the stack below. Although this device satisfactorily performs its intended function, it has not solved the problem as has the present invention of providing a device that will continuously grasp workpieces in a positive and simplified manner.

SUMMARY OF THE INVENTION

The present invention comprises a support bracket carrying a roller covered with a material having a high coefficient of friction, such as rubber, and is coupled with a ratchet device carried by the bracket so that when the roller is moved on the stack of pieces in one direction it is prevented from rotating by means of the ratchet coupling and when it is moved in the opposite direction, the roller can rotate about its own axis. The fulcrum or pivot point of the support bracket is supported by a spindle arranged to move up and down within a block resting on the stack of pieces. When the roller moves towards the block while it is still resting on the stack, it causes the top piece to form a bunch or fold which is trapped between the roller and the block and allows the piece to be manually removed when the device is raised clear of the stack.

Further features of the present invention consist in that:

the block is provided with a projection against which the piece is trapped by the roller;

at its lower portion the spindle is provided with a collar which rests on the stack of pieces when the roller is at its outermost position and is substantially against the upper portion of the block for the raising thereof when the roller is against the block itself with the fold portion being trapped therebetween;

the support bracket is provided with two side ears which enclose the block so that when the roller is moved across the stack of pieces it is guided with respect to the block against the block projection;

a switch is provided which closes an electric circuit when the roller is at its outermost position, so that in this position the electric circuit is closed on a means which causes the spindle to rise automatically and, therefore, the roller to move across the stack against the block to effect trapping the fold portion therebetween.

These features and the advantages of the device will become more fully apparent by reference to the appended claims and as the following detailed description proceeds in reference to the figures of drawing wherein:

DESCRIPTION OF THE PREFERRED EMBODIMENT

Figure 3:
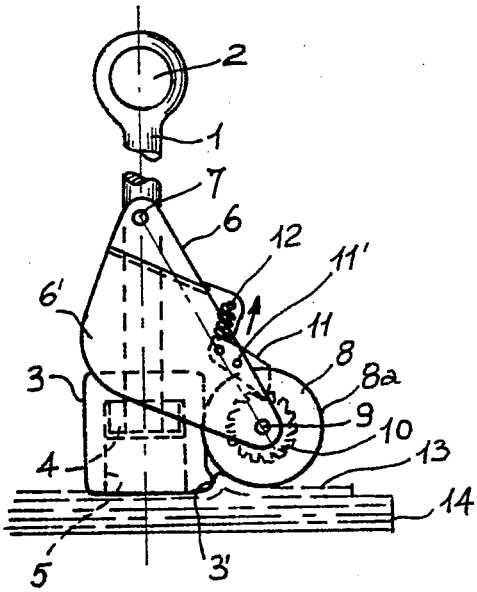
FIG. 3 is an elevational view of the device showing the piece trapped between the roller and block projection.
Figure 2:
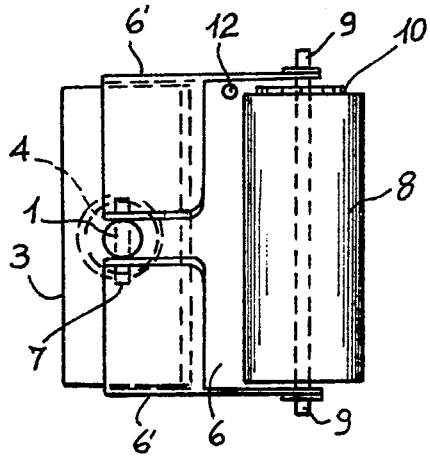
FIG. 2 is a plan view of the device as shown in FIG. 1.

As shown in the drawings, the upper portion of a spindle 1 is provided with a hole 2 through which a cross bar is carried by a picking up machine (not shown) is engaged and extends downwardly through a block 3 which is caused to rest on the stack of pieces to be grasped. At its lower portion, spindle 1 is provided with a collar 4 which slides up and down in hole 5 drilled in block 3 during the raising and lowering of spindle 1.

Figure 1:
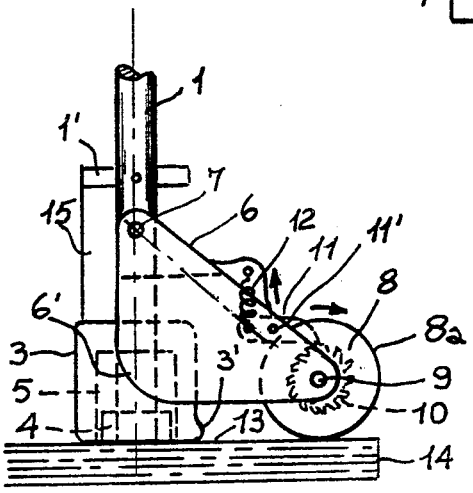
FIG. 1 is an elevational view of the device showing the roller in its outermost position.

Spindle 1 also carries a support bracket 6 which is hinged at fulcrum 7 and which, in turn, carries a roller 8 covered with material such as rubber. Roller 8 is rotatably supported by a pin 9 and is operatively connected to a toothed wheel 10 in mesh with a pawl 11 which together form a ratchet coupling hinged on the support bracket 6 at 11'. The pawl 11 is actuated by a coil spring 12 so that when roller 8 is moved across the upper piece 13 of the stack of pieces 14 from the position shown in FIG. 1 towards spindle 1 (FIG. 3), it is prevented from rotating by the pawl 11 which penetrates between two teeth of the toothed wheel 10. conversely, when it is moved in the opposite direction from the position of FIG. 3 to that of FIG. 1, roller 8 is allowed to rotate about its axis along the top piece 13 of the stack of pieces 14.

When roller 8 is in its outermost position (FIG. 1), collar 4 rests on the stack of pieces 14 and when it moves away from this position towards block 3 it is prevented from rotating by the pawl 11 so as to form a fold on the piece 13 which is disposed on top of the stack 14 and is trapped against a projection 3' of block 3 in a manner suitable to permit manual removal thereof when the device is raised by a machine (not shown).

The support bracket 6 is also provided with two side ears 6' which enclose the block 3 thereby preventing the rotation of the block so that the roller during the rising of spindle 1 moves horizontally on the stack of pieces 14 and is guided with respect to block 3 against projection 3' thus causing a positive grasping of the top piece of the stack.

Fixed to the spindle 1 is an electric contact 1' integral to block 3 which closes a switch 15 when roller 8 is at its outer position. In this position the electric circuit which is closed by the switch 15 causes the spindle to rise automatically by any suitable means (not shown) thereby moving the roller on the stack 14 against the block so that the piece will be grasped.

A second switch (not shown in the drawings) can be provided which causes roller 8 to return to its outer position, i.e. the position in which block 3 is resting on the stack of pieces after the grasped piece has been removed.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A grasping device for forming a fold in a piece of textile material to facilitate its removal from the top of a stack of a multiplicity of such pieces, said grasping device comprising:

(a) a block (3) for engaging the upper piece of textile material on the stack;

(b) a spindle (1) extending upwardly from said block (3) and mounted for vertical sliding movement therein;

(c) means defining a support bracket (6) pivotably attached at one end on said spindle including:

(i) a roller (8) rotatably mounted on the opposite end thereof for movement toward and away from said block (3) during the upward and downward movement respectively of said spindle; and (d) means interconnecting said roller (8) and support bracket (6) for preventing rotation of said roller during its movement toward said block (3) to effect the formation of a fold therebetween.

2. The grasping device according to claim 1, wherein said block (3) includes a projection (3') against which the piece of textile material is pushed by said roller (8) to form a fold therebetween.

3. The grasping device according to claim 2, wherein said support bracket (6) includes a side ear (6') on each side thereof for partially enclosing said block (3) and to guide said roller (8) toward said projection (3') during the upward movement of said spindle (1).

4. The grasping device according to claim 1, wherein said spindle (1) includes a collar (4) fixed on the lower end thereof for engaging the stack and for confined vertical movement with said spindle within said block (3).

5. The structure according to claim 1, wherein said preventing means includes:

(a) a toothed wheel (10) fixed on one end of said roller (8);

(b) a pawl (11) pivotably mounted on said support bracket (6); and (c) biasing means for continually urging said pawl into meshing relationship with said toothed wheel (10).

6. The structure according to claim 1, wherein said roller (8) is covered with a material having a high coefficient of friction.

* * * * *